US008747208B2

(12) United States Patent
Fisk et al.

(10) Patent No.: US 8,747,208 B2
(45) Date of Patent: Jun. 10, 2014

(54) MULTI-MEDIA SYSTEM FOR LOTTERY DRAWS

(75) Inventors: Michael G. Fisk, Newport, RI (US); Budd O. Libbey, Atlanta, GA (US); Daniel W. Bower, Atlanta, GA (US); Robert Davidge, Pass Christian, MS (US)

(73) Assignee: Scientific Games International, Inc., Newark, DE (US)

( * ) Notice: Subject to any disclaimer, the term of this patent is extended or adjusted under 35 U.S.C. 154(b) by 852 days.

(21) Appl. No.: 11/890,903

(22) Filed: Aug. 7, 2007

(65) Prior Publication Data

US 2008/0167110 A1 Jul. 10, 2008

(51) Int. Cl.
*A63F 9/24* (2006.01)

(52) U.S. Cl.
USPC ..... 463/17; 463/31

(58) Field of Classification Search
USPC ..... 463/17
See application file for complete search history.

(56) References Cited

U.S. PATENT DOCUMENTS

| | | | | |
|---|---|---|---|---|
| 4,257,107 | A | | 3/1981 | Heymsfield et al. |
| 4,288,077 | A | | 9/1981 | Rose et al. |
| 4,339,798 | A | | 7/1982 | Hedges et al. |
| 4,429,877 | A | | 2/1984 | Coppock |
| 4,494,197 | A | | 1/1985 | Troy et al. |
| 4,540,174 | A | | 9/1985 | Coppock |
| 4,651,995 | A | | 3/1987 | Henkel |
| 4,661,906 | A | | 4/1987 | DiFrancesco et al. |
| 4,689,742 | A | | 8/1987 | Troy et al. |
| 4,752,836 | A | | 6/1988 | Blanton |
| 4,768,151 | A | | 8/1988 | Birenbaum et al. |
| 4,795,161 | A | | 1/1989 | Chao |
| 4,873,585 | A | | 10/1989 | Blanton et al. |
| 4,883,636 | A | | 11/1989 | Fantle, Jr. |
| 4,909,516 | A | | 3/1990 | Kolinsky |
| 4,951,039 | A | | 8/1990 | Schwendeman et al. |
| 4,959,783 | A | * | 9/1990 | Scott et al. ..... 463/22 |
| 5,007,649 | A | | 4/1991 | Richardson |
| 5,035,422 | A | | 7/1991 | Berman |
| 5,043,887 | A | | 8/1991 | Richardson |
| 5,069,453 | A | | 12/1991 | Koza et al. |
| 5,212,636 | A | | 5/1993 | Nakazawa |
| 5,264,933 | A | | 11/1993 | Rosser et al. |
| 5,283,734 | A | | 2/1994 | Van Kohorn |
| 5,286,023 | A | | 2/1994 | Wood |

(Continued)

FOREIGN PATENT DOCUMENTS

| | | |
|---|---|---|
| AU | 712279 | 11/1999 |
| AU | 1999 30163 A1 | 1/2000 |

(Continued)

OTHER PUBLICATIONS

U.S. Appl. No. 09/900,235, filed Jul. 6, 2001, Libby et al.

*Primary Examiner* — Tramar Harper
(74) *Attorney, Agent, or Firm* — Dority & Manning, P.A.

(57) ABSTRACT

A system for conducting a lottery draw, the system including: (a) a database of pre-recorded video files of one or more humans, (b) a lottery number drawing means for randomly selecting one or more lottery numbers to determine one or more winning numbers for a game draw, and (c) display means for displaying one or more of the video files from the database based upon either (1) a predetermined characteristic of the game draw or (2) a number which is selected by the drawing means.

5 Claims, 1 Drawing Sheet

(56) References Cited

U.S. PATENT DOCUMENTS

| | | | | |
|---|---|---|---|---|
| 5,297,802 | A | 3/1994 | Pocock et al. | |
| 5,351,970 | A | 10/1994 | Floretti | |
| 5,354,069 | A | 10/1994 | Guttman et al. | |
| 5,380,007 | A | 1/1995 | Travis et al. | |
| 5,380,206 | A | 1/1995 | Asprey | |
| 5,411,258 | A | 5/1995 | Wilson et al. | |
| 5,415,416 | A | 5/1995 | Scagnelli et al. | |
| 5,518,239 | A | 5/1996 | Johnston | |
| 5,569,082 | A | 10/1996 | Kaye | |
| 5,590,879 | A | 1/1997 | Tripp | |
| 5,679,007 | A | 10/1997 | Potdevin et al. | |
| 5,679,077 | A | 10/1997 | Pocock et al. | |
| 5,687,971 | A | 11/1997 | Khaladkar | |
| 5,722,890 | A | 3/1998 | Libby et al. | |
| 5,904,619 | A | 5/1999 | Scagnelli et al. | |
| 5,910,047 | A | 6/1999 | Scagnelli et al. | |
| 5,921,865 | A | 7/1999 | Scagnelli et al. | |
| 5,938,200 | A | 8/1999 | Markowicz et al. | |
| 5,951,396 | A | 9/1999 | Tawil | |
| 6,012,984 | A | 1/2000 | Roseman | |
| 6,024,641 | A | 2/2000 | Sarno | |
| 6,033,308 | A | 3/2000 | Orford et al. | |
| 6,099,407 | A | 8/2000 | Parker, Jr. et al. | |
| 6,168,521 | B1 | 1/2001 | Luciano et al. | |
| 6,193,605 | B1 | 2/2001 | Libby et al. | |
| 6,280,324 | B1 | 8/2001 | Tenenbaum | |
| 6,280,325 | B1 | 8/2001 | Fisk | |
| 6,280,328 | B1 | 8/2001 | Holch et al. | |
| 6,311,976 | B1 | 11/2001 | Yoseloff et al. | |
| 6,331,143 | B1 | 12/2001 | Yoseloff | |
| 6,358,150 | B1 | 3/2002 | Mir et al. | |
| 6,478,676 | B1 | 11/2002 | Dayan | |
| 6,530,842 | B1 | 3/2003 | Wells et al. | |
| 6,585,590 | B2 | 7/2003 | Malone | |
| 6,592,454 | B2 | 7/2003 | Libby et al. | |
| 6,921,331 | B2 | 7/2005 | Gatto et al. | |
| 6,955,604 | B1 * | 10/2005 | Graves et al. | 463/42 |
| 7,674,169 | B2 | 3/2010 | Libby et al. | |
| 2001/0003100 | A1 | 6/2001 | Yacenda | |
| 2001/0039210 | A1 * | 11/2001 | ST-Denis | 463/42 |
| 2002/0010012 | A1 | 1/2002 | Dayan et al. | |
| 2002/0138836 | A1 * | 9/2002 | Zimmerman | 725/46 |
| 2003/0008695 | A1 | 1/2003 | Libby et al. | |
| 2003/0087683 | A1 | 5/2003 | Gatto et al. | |
| 2003/0119578 | A1 * | 6/2003 | Newson | 463/20 |
| 2004/0121834 | A1 | 6/2004 | Libby et al. | |
| 2006/0009285 | A1 * | 1/2006 | Pryzby et al. | 463/30 |
| 2006/0063575 | A1 * | 3/2006 | Gatto et al. | 463/1 |

FOREIGN PATENT DOCUMENTS

| | | |
|---|---|---|
| AU | 2002 11974 | 8/2002 |
| WO | WO 94/13374 | 6/1994 |
| WO | WO 01/08761 | 2/2001 |
| WO | WO 02/45808 | 6/2002 |

* cited by examiner

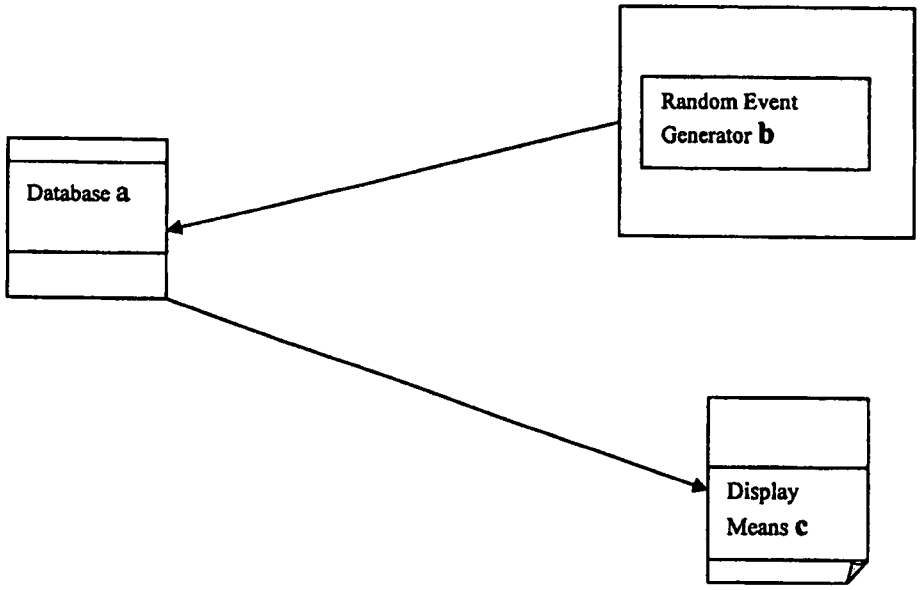
Random Event
Generator b
Database a
Display
Means c

MULTI-MEDIA SYSTEM FOR LOTTERY DRAWS

BACKGROUND OF THE INVENTION

Traditional public lottery drawings, including but not limited to those operated by governmental agencies to generate revenue, have been conducted traditionally using a device which enables a substantially random selection of lottery numbers and a display of the numbers selected. The display of the numbers selected has typically involved a video display of the numbers themselves in a more or less clerical or sterile fashion to determine and announce the winning number(s). While systems have been devised to automate or to make "virtual" the lottery number drawing process to a certain extent and to televise graphical representations of the lottery numbers drawn, a need still exists for a way to engage the public in the lottery process to increase the public's awareness, interest and participation in the drawings.

SUMMARY OF THE INVENTION

The disadvantages of prior systems can be overcome by providing a multi-media drawing system in accordance with the present invention.

The present invention provides a novel multi-media drawing system for a lottery. In this embodiment of the invention there is provided a system for conducting a lottery draw, the system comprising (a) a database of pre-recorded video files of one or more humans; (b) a lottery number drawing means for randomly selecting one or more lottery numbers to determine one or more winning numbers for a game draw; and (c) display means for displaying one or more of the video files from the database based upon either (1) a predetermined characteristic of the game draw or (2) a number which is selected by the drawing means.

BRIEF DESCRIPTION OF THE FIGURES

The foregoing and other features and advantages of the invention will become apparent upon reading the following detailed description of the invention in conjunction with the attached drawing in which:

FIGURE is a schematic diagram of a embodiment system of this invention.

DETAILED DESCRIPTION OF THE PREFERRED EMBODIMENTS

The present invention provides a novel multi-media drawing system for a lottery. In this embodiment of the invention there is provided a system for conducting a lottery draw, the system comprising (a) a database of pre-recorded video files of one or more humans; (b) a lottery number drawing means for randomly selecting one or more lottery numbers to determine one or more winning numbers for a game draw; and (c) display means for displaying one or more of the video files from the database based upon either (1) a predetermined characteristic of the game draw or (2) a number which is selected by the drawing means.

In this embodiment of this invention, actual images of real people are prerecorded stating a lottery number or some other element of the lottery drawing process. These video files are placed in a database, and from the database, files are selected for broadcast or display, depending on the lottery ball/number drawn or a characteristic of the particular game draw undertaken. Display means are provided for displaying the video file or files which are selected in conjunction with the lottery draw. This personal interaction and integration of real people packages and delivers winning lottery numbers and messages using the lottery's host or real people and integrates the lottery's games into players' lifestyles. Real people from the community serve as messengers for the lottery, delivering the winning numbers, announcing jackpot amounts, and sharing winning experiences and lottery information on television broadcast, radio broadcast and/or over the Internet, e.g., through computers and portable/wireless devices. In this way, the present invention transforms the role of traditional lottery drawings from serving as a passive, clerical function, to being a powerful and proactive marketing vehicle.

By showcasing real people, celebrities, players and citizens of the state or various jurisdictions participating in a lottery draw during the broadcast, the attention of the viewing public is captured. The integration of the images of real people in the drawing process adds credibility, fun and entertainment to the lottery drawings, because people typically enjoy seeing themselves, their friends and their neighbors in a public broadcast. At the same time, this invention helps those operating the lottery in shaping the public's perception of lottery players, helps to broaden demographic appeal, and builds public support for the lottery, while also often saving production costs compared to live draws. [0006] Traditional lotteries award fortunes in the form of jackpots and lower tier prizes to relatively few winners compared to the number of wagers placed. The numbered balls used in the drawing process are merely instruments. However, a lottery system incorporating this embodiment of the present invention will appeal to those seeking a moment of frame or publicity. This compounds the effectiveness of the lotteries' prizes offered to the players and public of legal age as well as fortifying the lotteries' advertising efforts through third party endorsements by the public.

To practice this embodiment of the present invention, video segments are collected either in a studio or at various public locations using web cameras, wireless cameras and devices like phones, consumer and professional cameras and/or camera kiosks. The video clips are then selected and digitized into separate assets and categories and stored in one or more relational databases ((a) on FIG. 1) in accordance with the respective lottery's game matrix. A separate certified random number generator ((b) on FIG. 1) selects the numbers, and an animated digital draw system pulls the proper video elements from disk and or database to create a complete lottery game drawing for the internet, intranet and/or TV broadcast of the number drawing and accompanying actual video recording, through display means ((c) on FIG. 1).

Site selection, promotion, pre and post editing, as well as asset and category selections are important features of the system. After the initial production, the lottery can update the database of video clips as needed to refresh the people assets within the database, whether the broadcast features core players calling the draw, or creates special promotions featuring local celebrities, business owners, lottery employees, or sports figures. This system engages the players and bridges the lottery games with its players by integrating players into games thus creating brand loyalty. It also increases the interest of viewers wanting to see themselves or others who may have been recorded for consideration on the show. This breathes new life in the lotteries' very mature on-line product life cycle as the lotteries face what's known as "jackpot fatigue," where people loose interest in the games, thus commanding higher jackpots before participating. It also permits the lotteries to feature people of less densely populated areas because naturally most winners typically come from the more populated areas of the state.

The present invention may employ, but is not required to employ, systems like the XML-based Random Animated Digital Draw System ("RADDS"), from Telecom Game Factory of Atlanta, Ga., which is a highly flexible digital system that produces secure, animated, broadcast quality draws, capable of delivery across all media including television, cable and/or the Internet. The present invention eliminates the need for expensive studio time with on-air talent, TV production equipment as well as making the traditional ball machines obsolete.

As used herein, the term "database" means a collection of data or other materials arranged in a systematic or methodical way and individually accessible by electronic or other means. In one embodiment of the present invention, the materials stored in the database are digital video files containing computer-readable information which can be translated into a series of video images.

Random event generators of this invention may include, e.g., lottery number drawing means, software programs installed and in use on a computer, slot machines, and computer-based machines which provide games of chance, for example, video poker machines, bingo machines and roulette-style machines, and the like, wherein such generators generate a random event. By random event it is meant that the event in question is not a certainty. Suitable random events include, e.g., selection of a number or a series of numbers, selection of a symbol or a pattern or a series of either or both, a color selection, a matching of two or more objects, card draws, dice throws, etc. Lottery number drawing means of this invention can include, for example, basket-type lottery number drawing devices, virtual lottery number drawing systems which employ computerized algorithm routines to generate lottery numbers (such as the RADDS system described above) and the like.

Display means of this invention may include, for example, a television or computer display, a broadcast or telecommunication system (e.g., the Internet) which sends signals to be received and converted into display images on a television or computer display and the like.

Predetermined characteristics of game draws which could be used to select the video file from the database of this invention can include, for example, the amount of the jackpot(s), the name(s) of the game being played, the winning number(s), winner awareness announcements and the like.

Predetermined characteristics of desired messengers' demographic profiles which could be used to select the video file from the database of this invention can include, for example, the race, sex, age, personality and geographic location of the messengers and the like.

In a further embodiment of this invention, the system is customized to meet the needs of the game involved, using a random number generator (preferably independently certified) to select the daily numbers combined with the preselected video clips by an animated digital draw system, e.g., RADDS, to create the lottery draws to allow each lottery to create a unique broadcast to meet their overall marketing strategies and customer desires.

Systems of this invention may incorporate a large number of video and audio elements stored within an animated digital draw system. These elements are added into, and/or changed in the system at anytime. For any given day's game the operator prepares the broadcast in advance by selecting the chosen elements, e.g., from easy-to-use pull down menus in a software interface. These elements include, but are not limited to, product introductions, specific or generic game information, backgrounds, any particular up-coming promotions being featured such as, e.g., a new instant ticket offering and the specific game module to be played. Once these elements have been selected and rendered, the Draw Manager waits for the on-line vendor to close sales for the game. At that time the daily numbers are selected by the Random Number Generator and, once verified by the auditor, are rendered by the RADDS component of the system to complete the broadcast either by TV, cable, closed-circuit monitor or over the Internet, e.g., through computers and portable/wireless devices.

With the systems of this invention, game operators will have the ability to customize their draw broadcast to maximize most any marketing strategy. The system is flexible, in that it can broadcast at any time, such as, day or nightly draws, traditional lotto-style games or additional new games. The system can also be configured to offer limited-run theme games or promotions, for example, "Holidays" at Christmas, cross-promotional games to feature a particularly well-selling instant ticket games or a general events theme, or beneficiary messages which, for example, describe how the lottery proceeds are distributed.

In embodiments of the invention which use a secured animated digital draw system, the digital draw system may require customization of individual components to address the unique requirements of a particular lottery or game. The following features are examples of components which may be customized:

- Game Structure Definition—Each broadcast may require specific structures to be defined and developed, such as establishing the length of broadcast, selecting promotional insertions, camera movement, recap definition, etc. Due to the inherent flexibility of available random animated digital draw systems like RADDS, there can be a different broadcast for each day of the week, different promotions, multi-state game affiliations, etc.
- Screen Customization—Customization of the screens involves adding specific games and lottery logos, adding or removing security steps as defined by the security and draw departments, adding promotional and asset selection structures, etc.
- Asset Creation and Customization—Because lotteries have unique graphic requirements, certain assets need to be created. This includes virtual studio creation, interior design, logo/studio fly-in, transitions, wrap-up presentation, promotions, disclaimers, jackpots, music track, chroma-key, etc. In addition, voice-overs for jackpot announcements, upcoming promotions and recaps are to be prepared and adapted for the system.
- Procedure Customization—Although there are standard procedures that have been used by multiple lotteries, there are unique security requirements for each lottery. These are customized according to the procedures as defined by the respective lottery's security and draw departments.

Systems of this invention preferably are custom designed and have a fully redundant secondary system, as well as an off-site backup system. Should a breakdown ever occur in the primary systems, a switch to the secondary system would then be undertaken to enable the broadcast nevertheless.

It can also be important that the integrity of the draw process be maintained at all times. It is highly recommended that the random number generator and the animated digital draw system, when employed for lotteries, be certified by an independent third party auditor of the respective lottery's selection to certify it for lottery use.

A kiosk capture system is an optional component in systems of this invention which involve installing portable self-contained video camera kiosks strategically placed in controlled public venues to record the lottery messengers. The promotional efforts leading up to the production and the nature of the locations, i.e. retailers, casinos, festivals, etc. compliments the capturing of a diversified demographic group and variety of people.

Each kiosk is equipped with a video camera (conventional or broadcast), instructional video monitor and a start and stop button. Messengers stand in front of the lens and simply follow the directions displayed on the screen. Recordings begin by depressing a large green button and stop after taping for thirty-seconds. The monitor screens display scripted numbers, promotional scripts, disclaimers, and jackpot amounts to be repeated by the messengers. While this component is supplemental to the inherently powerful marketing tool that is the system of this invention, it is highly effective in integrating the lottery into the players' lifestyles. The kiosks are easily delivered and installed by lottery technicians and require electricity and protection from the weather. The videotape is replaced in the camera on an as needed basis.

Another optional component is a filming/taping component which includes, but is not limited to, using professional or conventional video cameras and devices to record real people in the studio or in the field at locations predetermined and promoted by the people or the lottery. This feature relates to promotional efforts leading up to the production. The high-traffic the nature of the locations, i.e. retail establishments, festivals, etc. compliment the capturing of a well-diversified demographic group and a wide variety of messengers. Real people can send their own recordings to the lottery for consideration for inclusion in the database.

The strategically placed camera crew stationed in a controlled public venue directs and records the lottery messengers. The people ad-lib or read scripted numbers, promotional scripts, disclaimers, and/or jackpot amounts as they are recorded for consideration for inclusion in the database as messengers.

Yet another option is to define new promotions and venues by collecting, screening and editing new video clips on a quarterly or "as needed" basis. In some cases, it may even be desirable for the video to be created and used on a "real time" basis (i.e., at or near the time the random event is generated) for use and display to the subjects of the video or others, or for use and display at a later time in conjunction with future generated events. As above, the raw video tape(s) will be transferred to VHS or some other recording media to provide a timecode burn-in window. The tapes are sent to the game operator for casting and clip selections. Upon selection, the appropriate video clips are converted and installed on RADDS or a like system.

Yet another embodiment of the present invention is a gaming device comprising: (a) a database of pre-recorded video files, (b) a random event generator for generating a random event, and (c) display means for displaying one or more of the video files from the database based upon either (1) a predetermined characteristic of the random event generated or (2) the event generated by the random event generator. Suitable examples of gaming devices of this invention include video lottery terminals, virtual lottery draw machines, slot machines, video poker machines, digital roulette machines, hand-held cell phones or other personal digital assistants, web sites, and the like.

It should be appreciated that, while specific embodiments of this invention have been described herein, various other embodiments of the invention may be contemplated by those of skill in the art in view of this disclosure. Accordingly, the scope of this invention is not limited to the specific embodiments described in detail herein. Rather, what is intended to be covered is that which is set forth in the ensuing claims and the equivalents thereof permitted as a matter of law. As used in this specification, means-plus-function clauses, if any, are intended to cover the structures described herein as performing the cited function and not only structural equivalents but also equivalent structures.

We claim:

1. A system for conducting a lottery draw, the system comprising:

(a) a database of pre-recorded video files of one or more humans;

(b) a lottery number drawing means for randomly selecting one or more lottery numbers to determine one or more winning numbers for a game draw, wherein the pre-recorded video files comprise the one or more lottery numbers; and (c) display means for displaying one or more of the video files from the database, wherein the video files have been recorded prior to the lottery number drawing means determining the one or more winning numbers for the game draw;

(d) a draw system that selects and compiles the pre-recorded video files of one or more humans to create a video wherein humans in the video are messengers of predetermined characteristics of the lottery game drawing such that a coordinated message is provided to a player via the video files, including but not limited to elements of the lottery game draw being conducted, the draw system selecting the pre-recorded video files from the database based on predetermined characteristics inherent to the messengers comprising race, sex, age, and status of the messengers, wherein the status of the messengers is reflective of the messengers being at least one of a celebrity, a business owner, a sports figure, or a friend or family member of the player, such that the predetermined characteristics of the lottery game drawing message are customized based on the predetermined characteristics inherent to the messengers.

2. The lottery system of claim 1, wherein predetermined characteristics of the game draw include an amount of a jackpot, a name of a game being played, game information, or winner awareness announcements.

3. The lottery system of claim 1, wherein the pre-recorded video files of one or more humans are changed on a random or periodic basis.

4. The lottery system of claim 1, wherein the system further includes a kiosk capture system that comprises a portable self-contained video camera kiosk placed in public venues to record video files of one or more humans for the specific targeted geographical location of lottery game players.

5. A gaming device for conducting a lottery draw, the device comprising:

(a) a database of prerecorded video files of one or more humans, (b) a lottery number drawing means for randomly selecting one or more lottery numbers to determine one or more winning numbers for a game draw, wherein the pre-recorded video files comprise the one or more lottery numbers; and (c) display means for displaying one or more of the video files from the database, wherein the video files have been recorded prior to the lottery number drawing means determining the one or more winning numbers for the game draw;

(d) a draw system that selects and compiles the pre-recorded video files of one or more humans to create a video wherein humans in the video are messengers of predetermined characteristics of the lottery game drawing such that a coordinated message is provided to a player via the video files, including but not limited to elements of the lottery game draw being conducted, the draw system selecting the pre-recorded video files from the database based on predetermined characteristics inherent to the messengers comprising race, sex, age, and status of the messengers, wherein the status of the messengers is reflective of the messengers being at least one of a celebrity, a business owner, a sports figure, or a friend or family member of the player, such that the predetermined characteristics of the lottery game drawing message are customized based on the predetermined characteristics inherent to the messengers.

* * * * *